US005465679A

United States Patent [19]

Mardikian

[11] Patent Number: 5,465,679

[45] Date of Patent: Nov. 14, 1995

[54] PERSONAL WATERCRAFT AND BOAT WITH SHOCK ABSORBING FLOORBOARDS

[75] Inventor: Albert Mardikian, Corona Del Mar, Calif.

[73] Assignee: Mardikian 1991 Irrevocable Trust, Corona Del Mar, Calif.

[21] Appl. No.: 232,675

[22] Filed: Apr. 25, 1994

Related U.S. Application Data

[63] Continuation of Ser. No. 65,619, May 21, 1993, abandoned.

[51] Int. Cl.[6] ..... B63B 17/00

[52] U.S. Cl. ..... 114/363

[58] Field of Search ..... 114/270, 360, 114/361, 362, 363, 343; 440/38

[56] References Cited

U.S. PATENT DOCUMENTS

| | | | |
|---|---|---|---|
| 194,580 | 8/1877 | Clark . | |
| 2,263,919 | 11/1941 | Darragh, Jr. | 20/4 |
| 2,270,902 | 1/1942 | Rubissow | 248/358 |
| 5,092,260 | 3/1992 | Mardikian | 114/285 |

FOREIGN PATENT DOCUMENTS

| | | | |
|---|---|---|---|
| 77589 | 4/1986 | Japan . | |
| 144284 | 6/1990 | Japan | 114/270 |

*Primary Examiner*—Stephen Avila
*Attorney, Agent, or Firm*—Klein & Szekeres

[57] ABSTRACT

A personal watercraft or boat has, in addition to an engine, drive means powered by the engine, and handlebars or steering column for steering the watercraft, a spring mounted floorboard on which the driver/occupant of the watercraft stands, or otherwise supports his or her full or partial weight. The spring mounted floorboard acts as a shock absorber and greatly increases comfort for the driver/occupant of the watercraft.

9 Claims, 2 Drawing Sheets

FIG. 1
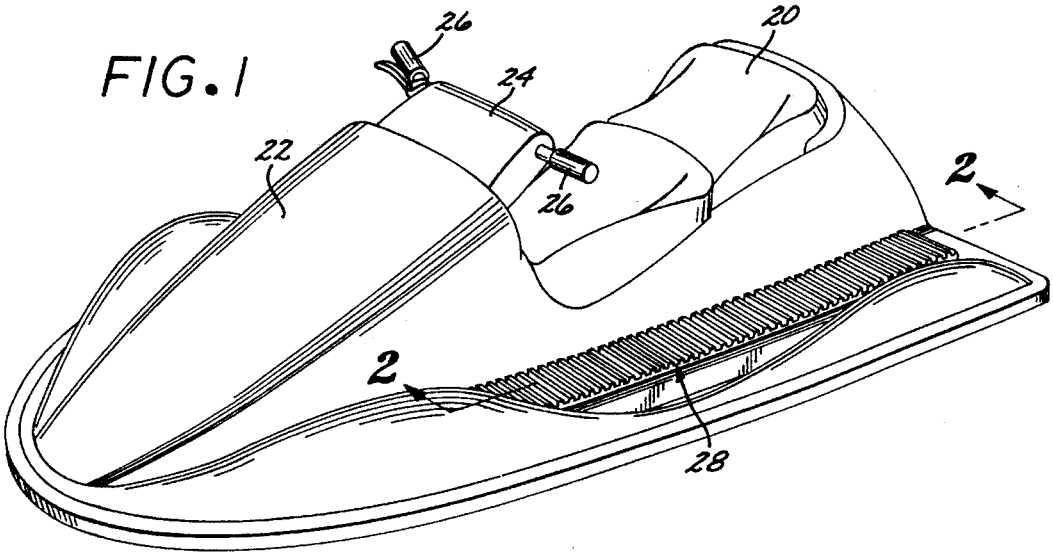
FIG. 2
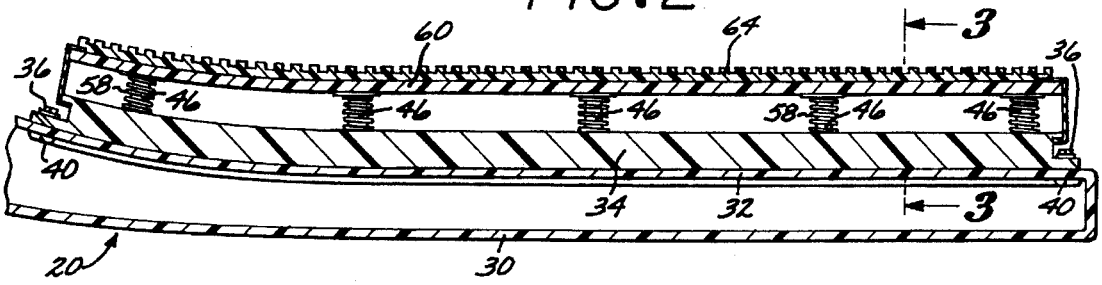
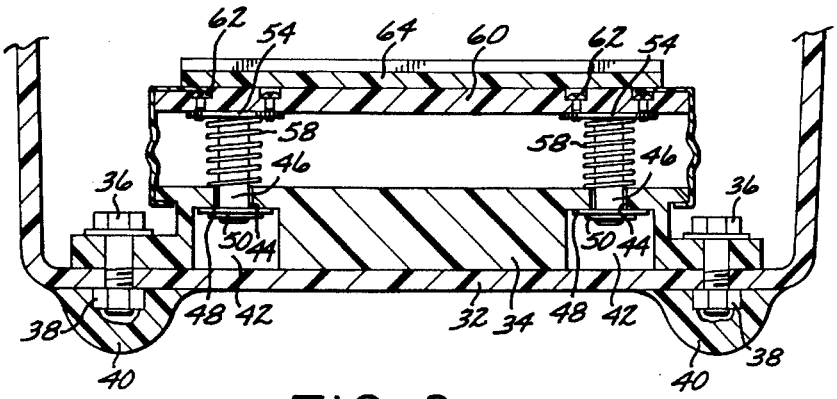
FIG. 3

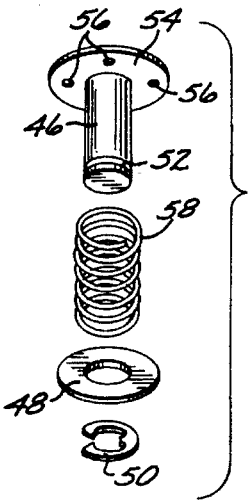
FIG. 4
FIG. 5
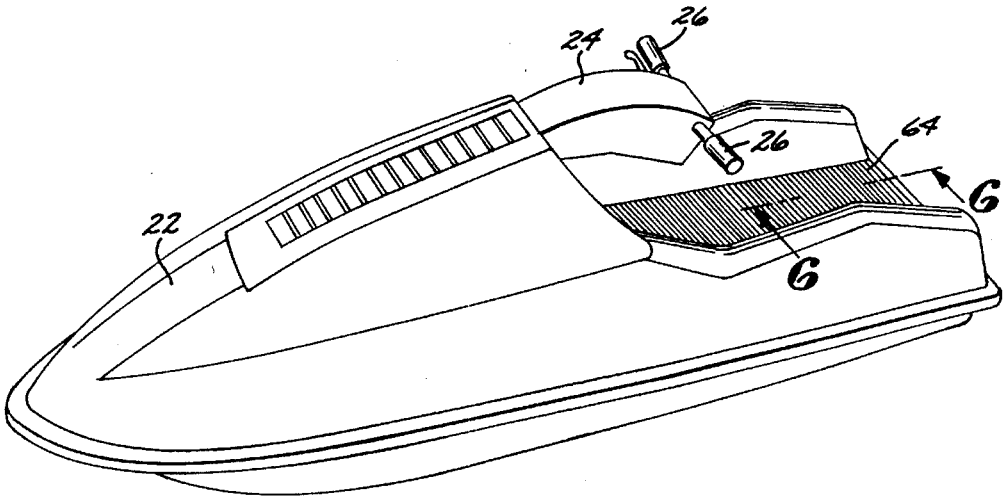
FIG. 6
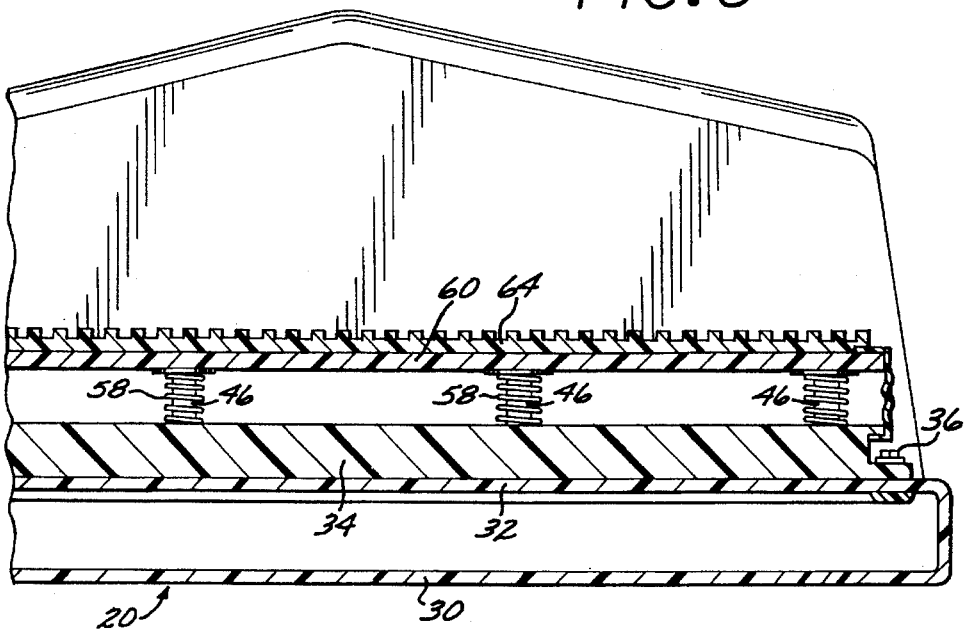

PERSONAL WATERCRAFT AND BOAT WITH SHOCK ABSORBING FLOORBOARDS

CROSS-REFERENCE TO RELATED APPLICATION

This application is a continuation of application Ser. No. 08/065,619, filed May 21, 1993, now abandoned.

BACKGROUND OF THE INVENTION

1. Field of the Invention

The present invention is directed to a personal watercraft, and particularly to a personal watercraft having a shock absorbing floor board. The present invention is also directed to a shock absorbing floor board usable in other type of watercrafts, such as speed boats.

2. Brief Description of the Prior Art

Personal watercraft are well known in the art. Such craft typically employs a jet pump for generating a rearwardly directed stream of water which provides the forward thrust required to propel the craft and its occupant. The direction of propulsion is controlled by the positioning of a movable steering nozzle which receives the stream of water from the pump and directs the flow so as to divide the thrust into the desired directional components. The positioning of the nozzle is affected by a steering cable system which connects the nozzle to a handlebar controlled by the driver of the watercraft. The handlebar typically includes a throttle control and an electrical on and off switch. U.S. Pat. No. 5,092,260 describes a personal watercraft which has an adjustable flap on the bottom of the craft, so that the angle at which the flap meets the water can be controlled by the operator of the craft. The flap can also serve as a brake. As far as the arrangement for accommodating the driver/occupant of the personal watercraft is concerned, one type of personal watercraft requires the occupant to stand on the watercraft while riding. This type of watercraft is also commonly known as a "jet ski". Although jet skis of this type are popular, a related sit-down type of personal watercraft has also recently gained great popularity. Such "sit-down" models include a seat which the driver usually occupies in sitting reclined or semi-prone position to drive the watercraft. It is well known that "stand-up" jet skis, as well the related "sit-down" models tend to be driven fast on the water. Therefore, the occupants of such watercraft are subjected to substantial shocks and bumps as the rapidly traveling watercraft meets the waves. In order to improve the comfort of the occupant/driver of personal watercraft, the present invention provides a shock absorbing floor board for the watercraft.

SUMMARY OF THE INVENTION

It is an object of the present invention to provide a personal watercraft which allows its occupant to travel on the watercraft in increased comfort.

It is another object of the present invention to provide a personal watercraft which has a spring mounted floor board on which the occupant of the watercraft stands or otherwise support his or her full or partial weight, to minimize bumps and shocks experienced while traveling fast on water.

It is still another object of the present invention to provide a spring mounted floorboard for personal watercraft and other boats which travel fast on water.

The foregoing and other objects and advantages are attained by a watercraft which has, in addition to an engine, drive means powered by the engine, and handlebars or steering column for steering the watercraft, a spring mounted floorboard on which the driver/occupant of the watercraft stands, or otherwise supports his or her full or partial weight. The spring mounted floorboard acts as a shock absorber and greatly increases comfort for the driver/occupant of the watercraft.

The features of the present invention can be best understood together with further objects and advantages, by reference to the following description, taken in connection with the accompanying drawings, wherein like numerals indicate like parts.

BRIEF DESCRIPTION OF THE DRAWINGS

FIG. 1 is a perspective view of a personal watercraft or jet ski of the type which the occupant/driver can drive while seated and also while standing on its spring mounted floorboard, in accordance with the first preferred embodiment of the present invention.

FIG. 2 is a cross-sectional view taken on lines 2,2 of FIG. 1.

FIG. 3 is another cross-sectional view taken on lines 3,3 of FIG. 2.

FIG. 4 is an enlarged exploded perspective view of a shaft and spring mechanism on which the floorboard is mounted in accordance with the present invention.

FIG. 5 is a perspective view of a personal watercraft or jet ski of the type which the occupant/driver drives while standing on its spring mounted floorboard, in accordance with the second preferred embodiment of the present invention.

FIG. 6 is a cross-sectional view taken on lines 6,6 of FIG. 5.

DESCRIPTION OF THE PREFERRED EMBODIMENTS

The following specification taken in conjunction with the drawings sets forth the preferred embodiments of the present invention. The embodiments of the invention disclosed herein are the best modes contemplated by the inventor for carrying out his invention in a commercial environment, although it should be understood that various modifications can be accomplished within the parameters of the present invention.

Referring now to FIGS. 1 to 3 of the appended drawings, the first preferred embodiment of the invention is disclosed. As it can be seen, the first preferred embodiment is a spring-mounted floorboard or side board which is utilized in a personal watercraft or jet ski of the type which has a seat 20 so that an occupant/driver can sit while traveling on the watercraft. The watercraft or jet ski includes a hull 22, a steering column 24 which includes handlebars 26, an engine (not shown), jet pump or propeller (not shown), and steering nozzles (not shown). As is known in the art, the occupant/driver steers the watercraft by turning the handlebars 26. The steering column 24 is hingedly mounted in the watercraft, and can be extended so that the occupant/driver may also be driving the watercraft in a standing, and sometimes in a heeling or like body posture. The components of the personal watercraft which have been hitherto described are conventional and well known and therefore their further and detailed description is not necessary. A side floor board 28 is disposed on each side of the seat 20, and the occupant/driver stands or heels on this side board 28 when he or she is not driving the watercraft in a seated body position. Alternatively, the occupant/driver places his or her feet on the side boards while sitting on the seat 20. In each of these situations full or partial weight of the occupant/driver is supported by the side floor board 28. It is a principal novel feature of the present invention that the side floor board 28 is spring mounted so as to act as a shock absorber. The preferred means for spring-mounting the floor board 28 is described with particular reference to FIGS. 2 and 3.

Thus, the hull 20 of the watercraft, which is normally made of fiberglass, includes a member 30 which forms the bottom of the watercraft. A second member 32 which, together with the bottom member 30 forms a sealed air chamber to provide extra flotation to the watercraft, is the floor plate of the hull. The novel mechanism which provides the spring mounted shock absorbing floorboard is mounted above the floor plate member 32 of the hull 20. A base member 34 which is conformed in shape to the floor plate member 32 is mounted to the floor plate member 32 by bolts 36 and nuts 38. In order to preserve the water tightness of the hull 20, the nut 38 which holds the bolt 36 is disposed within a small chamber 40 integrally constructed with the floor plate 32.

The base member 34 is of substantial thickness (in the herein described preferred embodiment it is approximately 3" thick) and incorporates a plurality of apertures or openings 42 which are open toward the floor plate member 32. The base member 34 is preferably made from fiberglass, or other strong plastic material such as KEVLAR. An aperture or hole 44 smaller in diameter than the opening 42 is located in the base member 34 aligned with each opening 42, and the bottom end of a shaft 46 is mounted into each opening 42 with a flat washer 48 and a C-clamp 50. The C-clamp 50 is received in a groove 52 disposed in the end of the shaft 46. The washer 48, the C-clamp 50 and groove 52 are best shown on FIG. 4.

The upper end of each shaft 46 includes a flange 54 which has threaded holes 56. A coil spring 58 is placed on the shaft 46 between the flange 54 and the upper surface of the base member 34. The tendency of the coil spring 58 is to bias the shaft 46 in an upwardly direction; in other words to extend the shaft as far upward as its mounting to the base member 34 allows. A platform 60, which is preferably also made from fiberglass, is mounted by bolts 62 to the flange 54. A rubber mat 64 having a non slippery regularly recessed upper surface is placed on the platform 60 for comfort.

As it should be readily apparent from the foregoing description and inspection of the drawing figures, space is created between the base member 34 and the platform 60 and the platform 60 is capable of moving up and down within this space against the biasing force of the coil springs 58. The openings or apertures 42 must be of sufficient depth to allow the end of each shaft 46 to move downward within the opening 42 when the platform 60 moves downward under weight or because of a substantial bump while the watercraft is traveling. In the herein described preferred embodiment the shafts 46 are approximately 2.5" long, and the space between the platform 60 and the base member is approximately 2.5" wide. The shafts 46 have a diameter of approximately 10 mm, and the coil springs 58 of the preferred embodiment have a rating in the 18 to 25 pound range. A protective boot 66, preferably made from rubber, is placed on each side of the platform 60, on the platform 60 and the base member 34, so as to substantially keep water and dirt out of the space between the platform 60 and the base member 34.

It should be readily apparent from the foregoing that due to the above-described structure the floor of the personal watercraft on which an occupant/driver stand, heels or in a seated position rests his or her feet, is spring mounted, and that shocks created by waves and other "bumps" while traveling on the watercraft are substantially absorbed by the spring-mounted floorboard. In this regard it should be understood that the platform 60 with the rubber mat 64 forms the spring-mounted floorboard. The personal watercraft which embodies the present invention provides greater comfort to its occupant/driver than personal watercraft of the prior art.

Referring now to FIGS. 5 and 6 of the appended drawings, a personal watercraft of the type is shown on which the driver/occupant usually stands while the watercraft is rapidly moving on water. Although this is not shown in the figures, it is well known that the steering column 24 of this type of personal watercraft is hinged, or extendible or both, so that the driver holds the handlebars 26 while standing on the watercraft. This type of personal watercraft has no seat, rather it includes a floor on which the driver/occupant heels or stands. In accordance with the present invention the floor is formed of a spring-mounted platform 60, covered by a rubber mat 64. The platform 60 is mounted on a plurality of spring-bearing shafts 46 in substantially the same way as is described above in connection with FIGS. 1–3. Thus the cross-sectional view of FIG. 6 shows the bottom member 30 and the floor plate member 32 which are part of the hull 22 of the watercraft. Above the floor plate member 32 is disposed the base member 34 to which the bottom end of the spring-bearing shafts 46 are mounted. The spring-bearing shafts support the platform 60.

Whereas the present invention has been described above in connection with personal watercraft, it should be remembered that the present invention is not limited to personal watercraft. Rather, the shock absorbing spring mounted floor or platform of the present invention can also be utilized in other type of watercraft, and is especially useful in watercraft which is designed to travel relatively fast. Several modifications of the present invention, both in terms of structural modifications and applications to other type of watercraft, may become readily apparent to those skilled in the art in light of the present disclosure. Therefore, the scope of the present invention should be interpreted solely from the following claims, as such claims are read in light of the disclosure.

What is claimed is:

1. A personal watercraft comprising:

a hull, a seat configured for seating the driver while the driver drives the watercraft;

two floor boards, the two floor boards disposed on the respective sides of the seat and forming a support surface on which the driver rests his or her feet while driving the watercraft, the floor boards extending from the front of the seat to the rear of the seat and shock absorbing spring means for mounting the floor boards to the hull in a position wherein the floor boards are capable of limited motion in an up-and down direction relative to the hull and are spring biased in an upwardly direction whereby the floor boards act to substantially absorb waves and bumps of the water and act as shock absorber while the watercraft travels on water, the shock absorbing spring means include a base which is disposed substantially parallel with an upper base surface of the hull and is fixedly attached thereto, a plurality of shafts movably affixed to the base and fixedly attached to the floor boards and a plurality of coil springs, each coil spring being mounted on one shaft and biasing the floor board in an upwardly direction.

2. The personal watercraft of claim 1 where the base has a plurality of openings and where one of the shafts is mounted into each of the openings.

3. The personal watercraft of claim 2 where each shaft has a flange attached to its upper end, and where the flange of each shaft is fixedly attached to the underside of the floor board.

4. The personal watercraft of claim 3 where the bottom end of each shaft is attached to the base by a C-clamp and a washer.

5. The personal watercraft of claim 4 where the bottom end of each shaft has a groove into which the C-clamp is mounted.

6. The personal watercraft of claim 1 further comprising rubber mats disposed above the floorboard.

7. A personal watercraft comprising:

a hull including a bottom member and a floor member which jointly define a closed air space for buoyancy;

a seat configured for seating the occupant while the occupant drives the watercraft;

two floor boards, the two floor boards disposed on the respective sides of the seat and forming a support surface on which the occupant rests his or her feet while driving the watercraft, and means for mounting the floor boards above the floor member of the hull in a substantially parallel relationship therewith and for spring biasing the floor board in an upwardly direction whereby while the watercraft travels on water waves and bumps are substantially absorbed by said means, the means for mounting and spring biasing comprise a plurality of shafts fixedly attached to the floor boards and a plurality of coil springs, each coil spring being located on one of the shafts, the coil springs exerting force between the underside of the floor boards and the floor member of the hull.

8. The personal watercraft of claim 7 further comprising a base member of substantial thickness which is disposed substantially parallel with the floor member of the hull and is fixedly attached thereto, the base member having a plurality of openings, one shaft being disposed in each of the openings.

9. In a personal watercraft having a hull, an upper base surface, a motor, a jet pump driven by the motor, a seat configured for seating the occupant while the occupant drives the watercraft, and two floor boards on which the feet of the occupant are placed while the occupant drives the watercraft, the improvement comprising:

shock absorbing spring means for mounting the floor boards to the hull in a position wherein the floor boards are capable of limited motion in an up-and down direction relative to the hull and are spring biased in an upwardly direction whereby the floor boards act to substantially absorb waves and bumps while the watercraft travels on water, the shock absorbing spring means including a base which is disposed substantially parallel with the upper base surface of the hull and is fixedly attached thereto, a plurality of shafts movably affixed to the base and fixedly attached to the floor boards and a plurality of coil springs, each coil spring being mounted concentrically on the shaft and biasing the floor boards in an upwardly direction.

* * * * *